US007637498B2

(12) United States Patent
Eugster

(10) Patent No.: US 7,637,498 B2
(45) Date of Patent: Dec. 29, 2009

(54) APPARATUS FOR STABILIZING PRINTED PRODUCTS BEING TRANSPORTED IN A CONTAINING STREAM OVER A DISTANCE HANGING FROM CLAMPS ON A CONVEYING DEVICE

(75) Inventor: Albert Eugster, Strengelbach (CH)

(73) Assignee: Müller Martini Holding AG, Hergiswil (CH)

( * ) Notice: Subject to any disclaimer, the term of this patent is extended or adjusted under 35 U.S.C. 154(b) by 229 days.

(21) Appl. No.: 11/412,661

(22) Filed: Apr. 26, 2006

(65) Prior Publication Data

US 2006/0244206 A1 Nov. 2, 2006

(30) Foreign Application Priority Data

Apr. 29, 2005 (EP) ..... 05405325

(51) Int. Cl.
*B65H 29/04* (2006.01)
*B65H 5/02* (2006.01)

(52) U.S. Cl. ..... 271/204; 271/277

(58) Field of Classification Search ..... 271/204, 271/205, 206, 277

See application file for complete search history.

(56) References Cited

U.S. PATENT DOCUMENTS

| | | | | |
|---|---|---|---|---|
| 4,577,855 | A * | 3/1986 | Reist | 271/281 |
| 4,678,174 | A * | 7/1987 | Reist | 270/52.3 |
| 5,110,108 | A * | 5/1992 | Muller | 271/69 |
| 5,128,726 | A * | 7/1992 | Cassano et al. | 399/394 |
| 5,169,139 | A * | 12/1992 | Stauber et al. | 271/204 |
| 5,188,349 | A * | 2/1993 | Honegger | 270/52.22 |
| 5,261,656 | A * | 11/1993 | Gutov et al. | 271/243 |
| 5,380,000 | A * | 1/1995 | Ohno | 271/277 |
| 5,794,930 | A * | 8/1998 | Glanzmann et al. | 271/277 |
| 6,213,461 | B1 * | 4/2001 | Ratz et al. | 271/187 |
| 2003/0019722 | A1 * | 1/2003 | Muller | 198/470.1 |
| 2003/0075853 | A1 * | 4/2003 | Hansch | 270/52.17 |
| 2003/0116908 | A1 * | 6/2003 | Honegger | 271/204 |

FOREIGN PATENT DOCUMENTS

| | | |
|---|---|---|
| EP | 0 218 804 | 4/1987 |
| EP | 0 481 914 | 4/1992 |

OTHER PUBLICATIONS

Webster's New Basic Dictionary, 2005, Houghton Mifflin Company, pp. 695.*

* cited by examiner

*Primary Examiner*—Patrick H Mackey
*Assistant Examiner*—Patrick Cicchino
(74) *Attorney, Agent, or Firm*—Friedrich Kueffner

(57) ABSTRACT

An apparatus for stabilizing printed products being transported in a conveying stream over a distance hanging from clamps of a conveying device for transferring the printed products into a processing unit, wherein the clamps are of at least two parts including a clamp part which is movably controlled for opening and closing the clamp, and wherein between spaced-apart printed products a guide arrangement is provided which travels with the printed products and prevents a deflection of the printed products. The guide arrangement which includes the stabilizing elements is fastened at least to an immovable clamp part which interacts with the moveable clamp part, wherein the guide arrangement is moveable from an ineffective position into a support position behind the printed products which are being transported in the conveying direction.

7 Claims, 2 Drawing Sheets

APPARATUS FOR STABILIZING PRINTED PRODUCTS BEING TRANSPORTED IN A CONTAINING STREAM OVER A DISTANCE HANGING FROM CLAMPS ON A CONVEYING DEVICE

BACKGROUND OF THE INVENTION

1. Field of the Invention

The present invention relates to an apparatus for stabilizing printed products being transported in a conveying stream over a distance hanging from clamps of a conveying device for transferring the printed products into a processing unit, wherein the clamps are of at least two parts and have a clamp part which is movably controlled for opening and closing the clamp, and wherein between spaced-apart printed products a guide arrangement is provided which travels with the printed products and prevents a deflection of the printed products.

2. Description of the Related Art

An apparatus of the above-described type is described, for example, in EP-0 481 914 A1 which shows printed products which are transported hanging from circumferentially traveling clamps of a transporting device, wherein the printed products are stopped at their rear sides by guide elements which are inserted into the conveying stream, such that the printed products assume a defined position prior to being transferred to a processing machine.

Apparatus of this type, which are operating in accordance with a certain method principle, always require additional space which is not available for each kind of application in processing of printed products.

SUMMARY OF THE INVENTION

Therefore, it is the primary object of the present invention to eliminate the disadvantage mentioned above and to further develop an apparatus of the above-described type in such a way that it meets the additional requirements for a problem-free transfer of printed products to a processing machine.

In accordance with the present invention, the guide arrangement which includes the stabilizing elements is fastened at least to an immovable clamp part which interacts with the moveable clamp part, wherein the guide arrangement is moveable from an ineffective position into a support position behind the printed products which are being transported in the conveying direction.

In accordance with a further development of the invention, the stabilizing elements of the guide arrangement may also be provided for the moveable clamp part, so that the printed products, irrespective in which direction they are being transported or influenced, are held in a stable position.

Moreover, it is provided that the stabilizing elements are formed of a strip-shaped section, for example, of spring steel, in order to keep the weight low.

In accordance with an advantageous feature, the stabilizing elements of the guide arrangement are immersed in the ineffective position in the clamp and/or raised out of this position into the stabilizing position.

In accordance with a preferred feature, at least over the effective width of a clamp always two spaced apart stabilizing elements are fastened with one end thereof at a clamping part and are controlled so as to be pivotable.

The portions which can be pivoted out of the clamp parts are advantageously provided at their fastening ends with a pinion which is part of an adjusting gear unit.

The drive of the pinion of the stabilizing element portions can take place, for example, through a rack which is guidable transversely of the conveying direction F.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
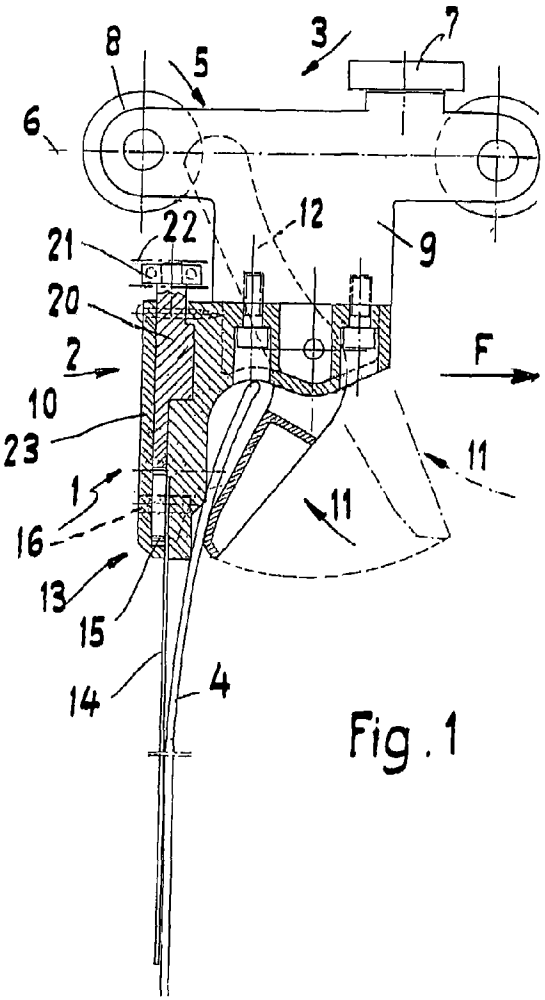
FIG. 1 is a sectional view of a clamp of a transporting device taken along sectional line I-I of FIG. 2.
Figure 2:
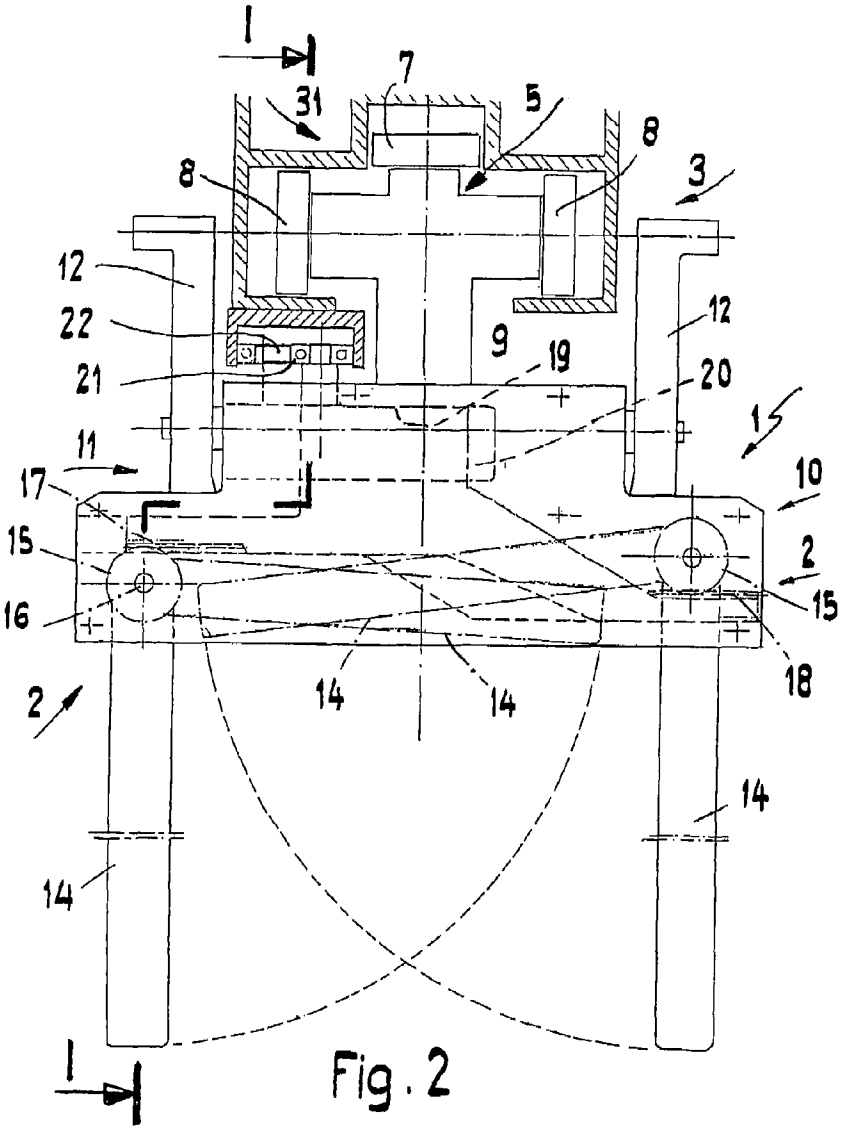
FIG. 2 is a side view of the clamp shown in FIG. 1.

FIGS. 1 and 2 show an embodiment of an apparatus 1 for stabilizing printed products 4 which are being transported in a conveying stream over an approximately horizontal distance so as to hang from clamps 2 of a conveying device 3, wherein the printed products 4 are transferred to a processing unit, for example, an inserting machine, a feeder, a stacking device, such as a cross-type stacker, a cutting machine, etc. Such conveying devices, which may also have upwardly or downwardly inclined sections, also called transporters, are composed of a plurality of links 6 which are suspended from each other in a guide rail 31. The chain links 5 each have an upper guide roller 7 and a pair of rollers which extend in a lateral guide arrangement, wherein the chain links 5, as is the case with the guide roller 7, are mounted in a link body 9. Screwed to each guide member 9 is a clamp 2, so that a uniform spacing is formed between the clamps 2. The clamps 2 are composed of at least two parts with a stationary clamp part 10 and a movable clamp part 11 for opening and closing the clamp 2. The arrow F indicates a conveying direction of the printed products 4. FIG. 1 shows a printed product 4 which is suspended in the area of the fold and in the clamp 2 between the stationary clamp portion 10 and the movable clamp portion 11. As a consequence, for example a spring, not shown, presses the movable clamp part 11 against the immovable clamp part 10 which is attached to the link body 9. Opening of the clamp body 2 and the release of the printed products takes place by means of a lever 12 which is attached to the movable clamp part 11 which is mounted on the immovable clamp part 10. FIG. 1 shows with a dash-dot line the open position of the clamp 2.

To ensure that the printed products 4 assume a stable position and be transferred, the printed products are guided at least over a certain distance at their rear sides as seen in the conveying direction F, and are supported against the force which is produced by the conveying movement. For this purpose, a guide arrangement 13 is provided which is moved from the clamp 2 in which it is in a position of rest, into a work position in which the printed products 4 rest against the clamp.

In the embodiment of FIGS. 1 and 2, the guide arrangement 13 is integrated in the immovable clamp part 10 and has stabilizing elements 14 which are arranged on the immovable clamp part 10 from where they can be moved from an ineffective position into a supporting position behind a printed product 4. The stabilizing elements 14, two of which are preferably provided for each clamp 2, are strip-shaped sections, for example, of strip or spring steel so that they have a low weight and are particularly well stretched in the pivoted out position in which it rests against the printed products 4. In the present case, a pinion 15 is fastened on one of the immovable clamp portions 10, wherein the pinion 15 is mounted on a shaft 16 supported in the immovable clamp portion 10. The actuation of the stabilizing elements 14 takes place by the respective rack 17, 18 which is fastened to a slide member 20 which is movable by means of the racks 17, 18 which are fastened to slide members 20 which are movable back and forth in a guide groove 19 transversely of the conveying direction F of the printed products 4. The drive of the slide member 20 which rotates the pinion 15 to the racks 17, 18 is achieved by a control roller 21 supported on the slide member 20 which at the distance for actuating the stabilizing elements 14 acts on a control cam 22 which moves the stabilizing elements 14 from the position of rest shown in dash-dot lines into the supporting position shown in solid lines, in which the stabilizing elements 14 are projecting pivoted perpendicularly downwardly behind a printed product 4.

In the position of rest, the stabilizing elements 14 are arranged next to each other immersed in the immovable clamp part 10, as shown in FIG. 2. The slide member 20 and the pinion 15 of a clamp 2 are guided on a plate 23 which is screwed to the immovable clamp portion 10 and is guided in this clamp portion 10.

Figure 3:
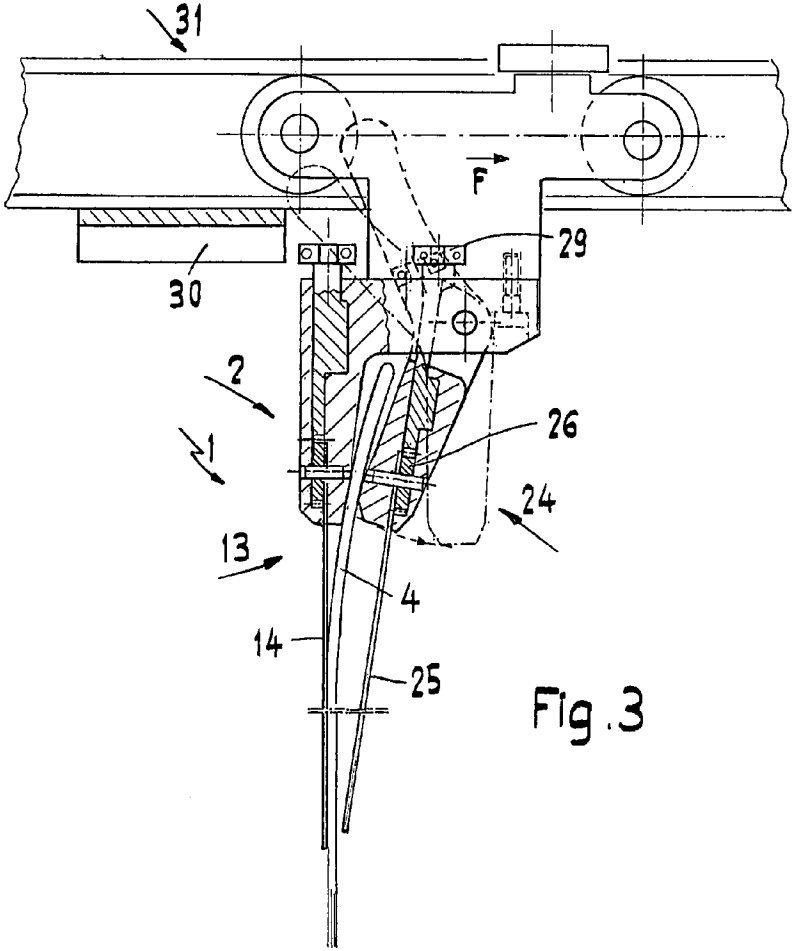
FIG. 3 is a sectional view of an alternative embodiment of a clamp of a transporting device taken along sectional line III-III of FIG. 4.
Figure 4:
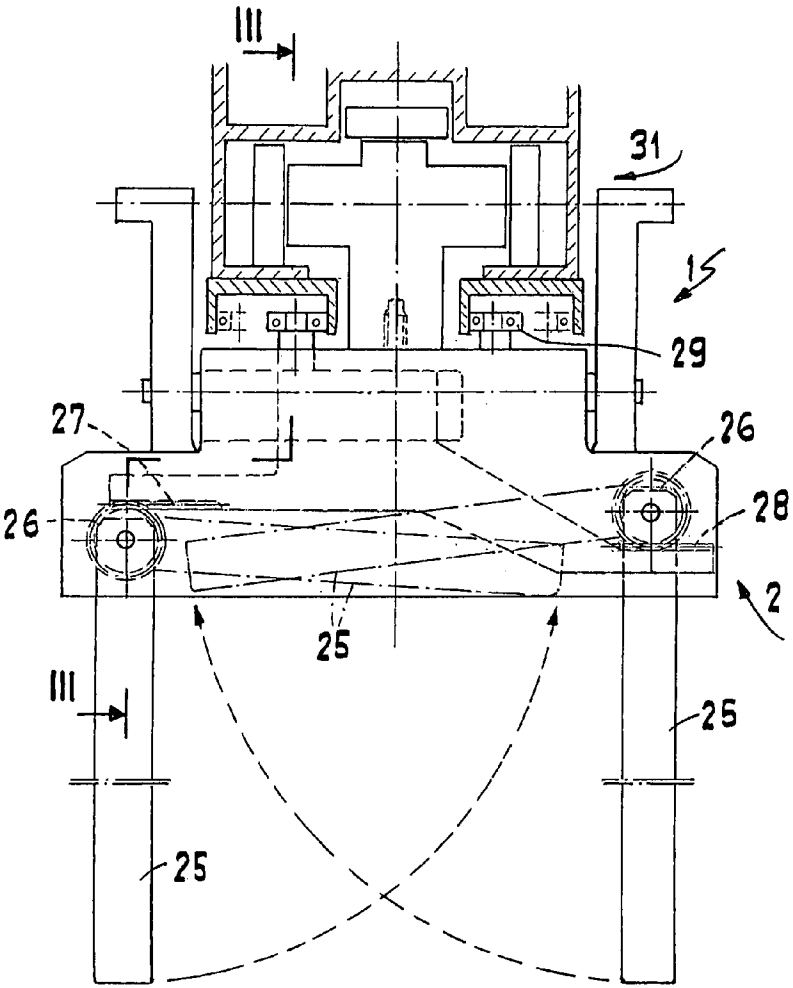
FIG. 4 is a side view of the clamp shown in FIG. 3.

FIGS. 3 and 4 show an alternative embodiment of an apparatus 1 for stabilizing printed products 4 which are conveyed hanging from clamps 2 of a conveying device 3, with the difference that in this case also the movable clamp part 11 is equipped with a guide arrangement 24.

The actuation of the stabilizing elements 25 provided for the movable clamping part 11 is once again effected by an adjusting gear unit formed of pinions 26 and racks 27, 28, wherein the gear unit is drive-connected with a second control roller 29 and a second control cam 30. FIG. 3 shows the position of the open clamp 2 in a dash-dot line.

While specific embodiments of the invention have been shown and described in detail to illustrate the inventive principles, it will be understood that the invention may be embodied otherwise without departing from such principles.

I claim:

1. An apparatus for stabilizing printed products which are transported in a conveying stream over a distance hanging from clamps of a conveying device for transferring the printed products into a processing unit, wherein the clamps are comprised of at least two parts including a clamp part movably controlled for opening and closing the clamp, and a guide arrangement, which travels with the printed products and prevents a deflection of the printed products being provided between spaced-apart printed products, wherein the guide arrangement with stabilizing elements is attached to at least one immovable clamp part which interacts with the movable clamp part of the clamp, and wherein the guide arrangement is movable from an ineffective position into a support position behind the printed products which are being transported in the conveying direction, wherein the stabilizing elements are immersible in the clamp in the ineffective position.

2. The apparatus according to claim 1, wherein the guide arrangement includes stabilizing elements for acting on the movable clamping part of the clamp, wherein the stabilizing elements can be placed in front of the printed products which are transported in the conveying direction.

3. The apparatus according to claim 1, wherein the stabilizing elements are comprised of a strip-shape section.

4. The apparatus according to claim 3, wherein, over at least approximately the effective width of a clamp, always to adjacent stabilizing elements are attached with one end thereof to a clamp part and are pivotally controlled.

5. The apparatus according to claim 4, wherein a fastening end of the stabilizing elements has a pinion of an adjusting gear unit.

6. The apparatus according to claim 5, wherein the adjusting gear unit has a cam-controlled rack meshing with the pinions.

7. The apparatus according to claim 6, wherein the racks are attached to a slide member and are driveable transversely of the conveying direction.

* * * * *